US007506726B2

(12) United States Patent
Andrejak et al.

(10) Patent No.: US 7,506,726 B2
(45) Date of Patent: Mar. 24, 2009

(54) COUNTER WEIGHTED SAFETY DEVICE FOR AN ELEVATOR

(75) Inventors: Jean-Marie Andrejak, Saint-Yrueux (FR); Arnaud Reoblin, Anville (FR)

(73) Assignee: Moteurs Leroy-Somer, Angouleme (FR)

( * ) Notice: Subject to any disclaimer, the term of this patent is extended or adjusted under 35 U.S.C. 154(b) by 544 days.

(21) Appl. No.: 11/300,468

(22) Filed: Dec. 15, 2005

(65) Prior Publication Data

US 2006/0137941 A1 Jun. 29, 2006

(30) Foreign Application Priority Data

Dec. 27, 2004 (FR) ..... 04 13948

(51) Int. Cl.
*B66B 1/06* (2006.01)

(52) U.S. Cl. ..... 187/290; 187/313

(58) Field of Classification Search ..... 187/277, 187/290, 296, 297, 391–394, 313; 307/64, 307/66; 318/375, 376, 788–816
See application file for complete search history.

(56) References Cited

U.S. PATENT DOCUMENTS 6,264,005 B1 * 7/2001 Kang et al. ..... 187/290
6,269,910 B1 * 8/2001 Fargo et al. ..... 187/287
6,435,312 B2 * 8/2002 Tajima et al. ..... 187/290
6,439,348 B2 * 8/2002 Tajima et al. ..... 187/290
6,471,013 B2 * 10/2002 Banno et al. ..... 187/290
6,474,447 B2 * 11/2002 Tajima et al. ..... 187/290
6,827,182 B2 * 12/2004 Araki ..... 187/290
2002/0100645 A1 8/2002 Bloch

FOREIGN PATENT DOCUMENTS

DE 197 54 034 A1 6/1999
WO WO 01/46056 A1 6/2001

* cited by examiner

*Primary Examiner*—Jonathan Salata
(74) *Attorney, Agent, or Firm*—Oliff & Berridge, PLC

(57) ABSTRACT

A safety device for an elevator includes a cabin, a counterweight, a cabin drive motor with a rotor, and at least one power-failure electromechanical brake. The safety device has a control device arranged to receive at least one information allowing emergency power to be applied to the brake in order to release the rotor, and allow the cabin blocked between two floors to move under the effect of unbalance between the weight of the cabin and the weight of the counterweight; to receive information enabling the speed of the cabin to be known; and to manage power supplied to the brake in such a manner as to enable the cabin to move to an evacuation floor while preventing the speed of the cabin from exceeding a predefined limit. The information that enables the speed of the cabin to be known is provided by at least one electrical magnitude from the motor.

12 Claims, 1 Drawing Sheet

COUNTER WEIGHTED SAFETY DEVICE FOR AN ELEVATOR

This non provisional application claims the benefit of French Application No. 04 13948 filed on Dec. 27, 2004.

The present invention relates to a safety device for an elevator comprising a cabin, a counterweight, a cabin drive motor, and a power-failure safety brake, i.e. a brake arranged, so long as it is electrically powered, to allow the rotor of the motor to rotate, and to oppose such rotation when not powered.

BACKGROUND

In the event of a failure in the operation of the elevator, and in particular in the event of a failure of the public or industrial electricity mains network powering the motor, or in the event of a failure of the motor or the converter, the elevator cabin can remain blocked between two floors at a level that does not allow the people inside the cabin to be evacuated.

Under such circumstances, an operator is called on to act to release the brake manually. Under the effect of being out of balance with the counterweight, the cabin can then move downwards or upwards in order to reach a door allowing it to be evacuated.

During this operation the operator controlling the brake must take care that the cabin does not move too quickly by visually estimating its speed, so as to ensure that the people it is carrying are safe and so as to avoid damaging the elevator.

Having recourse to a visual estimate of the speed is not very satisfactory in terms of safety and makes the action difficult to perform.

International patent application WO 01/46056 discloses a safety device in which the electricity delivered by the motor under the effect of the cabin moving is dissipated in an electrical resistance, thereby tending to brake the rotor. Such a device reduces acceleration of the cabin, but it does not eliminate the need to take manual action on the brake. Furthermore, that device is ineffective in the event of a failure in the electrical circuit connecting the motor to the resistance in which energy is dissipated.

SUMMARY

Consequently there remains a need to improve safety devices for elevators, in particular to make it easier for an operator to take action to release people held prisoner in the cabin.

The invention seeks to satisfy this need and it achieves this object by a safety device for an elevator that comprises a controlled device arranged:

- to receive at least one information allowing emergency power to be applied to the brake in order to release the rotor and allow the cabin blocked between two floors to move under the effect of unbalance between the weight of the cabin and the weight of the counterweight;
- to receive at least one information enabling the speed of the cabin to be known; and
- to manage power supply to the brake in such a manner as to enable the cabin to move to an evacuation floor while preventing the speed of the cabin from exceeding a predefined limit.

By means of the invention, the operator need have no fear that the speed of the cabin will exceed a predefined limit, and has-no need to estimate cabin speed visually.

The information giving the speed of the cabin can be provided by at least one electrical magnitude from the motor, in particular its remanent voltage. This can make it possible to omit providing a special sensor and can increase the reliability while of the safety device while reducing its cost.

The control device can be arranged to receive information representative of the arrival of the cabin at the evacuation floor and to interrupt powering the brake automatically when said information is received. This facilitates the task of the operator since no action is required on the part of the operator between the time when operation of the safety device is started and the time when the cabin stops at the floor for evacuating the people it contains. The evacuation floor need not be one of the floors between which the cabin was initially situated.

The control device can be arranged to analyze the amplitude of the remanent voltage induced by the rotation of the rotor and the frequency of said voltage, and if they are inconsistent, to generate an error signal.

The safety device may comprise a battery to power the brake in the absence of mains electricity. The safety device may then comprise, when necessary, a voltage-raising device to raise the voltage delivered by the battery to a value that is compatible with powering the brake.

The brake may be powered intermittently with a time-out of predetermined duration between two consecutive applications of power to the brake. That makes movement of the cabin less uncomfortable.

The safety device may comprise a circuit for powering the brake that comprises at least first and second switches having contacts that must both be ON in order to power the brake, the first switch being controlled by a signal that is independent of the control device, the second switch being controlled both by a signal that is independent of the control device and by a signal that comes from the control device. This makes it possible to establish redundancy that reinforces safety.

In an embodiment, the invention provides elevator machinery fitted with a safety device as defined above.

In an embodiment, the invention also provides an elevator fitted with a safety device as defined above.

BRIEF DESCRIPTION OF THE DRAWING

The invention can be better understood on reading the following detailed description of an embodiment of the invention, and on examining the accompanying drawing, in which.

MORE DETAILED DESCRIPTION

Figure 1:
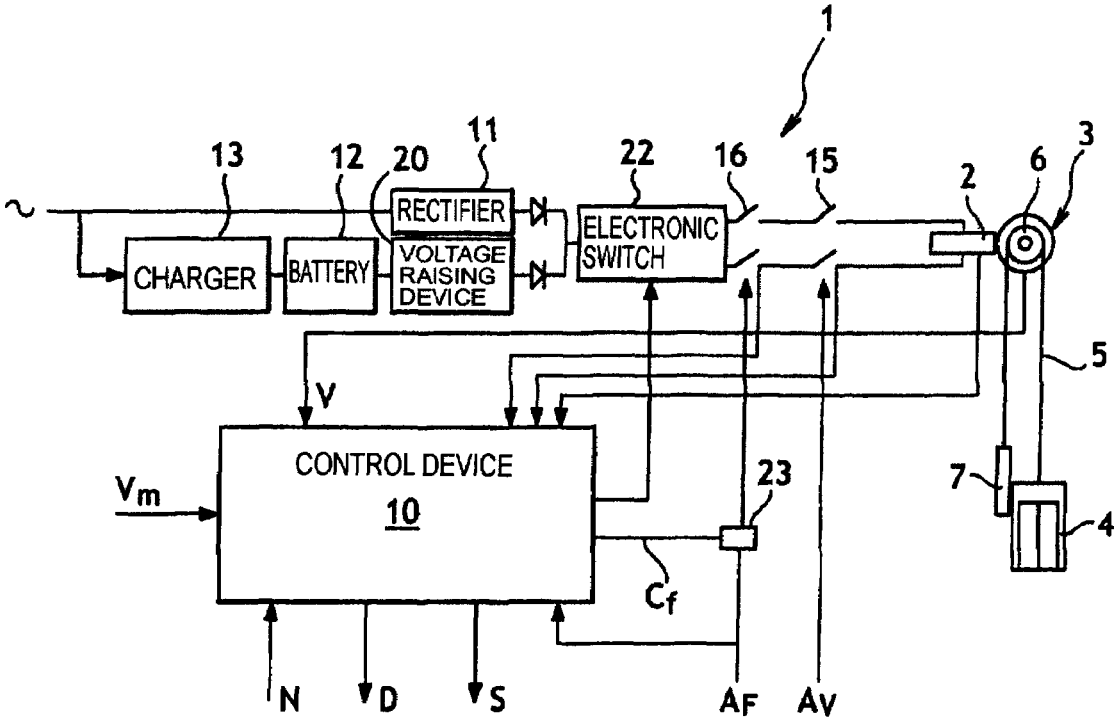
FIG. 1 is a diagrammatic view of a safety device in accordance with the invention.

The safety device 1 shown in FIG. 1 is associated with an elevator that is shown highly diagrammatically, comprising in conventional manner a cabin 4 connected to a counterweight 7 by a system of cables 5 driven by a pulley that rotates with the rotor 6 of an electric motor 3, e.g. an induction motor or a permanent magnet motor.

A power-failure brake 2 serves to hold the rotor 6 stationary when there is no electrical power feed to the motor 3.

By way of example, the brake 2 may be powered by a direct current (DC) voltage greater than 100 V, e.g. 190 V.

The safety device 1 comprises a control device 10 arranged to receive at least one information V representative of the speed of the cabin 4 when it moves under the effect of unbalance between its own weight and the weight of the counterweight 7.

The control device 10 may comprise a microprocessor or microcontroller programmed to perform the desired functions, or any analogous components, or in a variant it could be implemented in purely analog manner.

In the example described, the control device 10 receives information representative of the remanent voltage across the terminals of the motor 3 under the effect of the cabin 4 moving.

In a variant that is not shown, the information concerning the speed of the cabin comprises, for example, a digital or analog signal that is generated in some other way, e.g. a pulse train produced by a rotor position sensor, e.g. a position sensor having an optical or a magnetic detector. The information about the speed of the cabin could also come from a telemeter secured to the cabin or to the counterweight, and it may be conveyed to the control device 10 over a wired or other connection.

The control device 10 contains or can receive information $V_m$ about the maximum speed authorized while the safety device 1 is in operation. This maximum speed $V_m$ can be preadjusted in the factory or when the elevator is installed, and it may optionally be modifiable by operating an adjustment member or by software, e.g. by means of a connection enabling information to be exchanged between the control device 10 and a terminal (not shown) connected by a wired or wireless connection to the control device 10 and using a predefined computer protocol.

The control device 10 is arranged in the example shown to deliver a signal S representative of the speed of the cabin 4 as received, measured, or calculated by the control device 10. By way of example, the polarity of this signal provides information about the travel direction of the cabin, while its amplitude provides information about its speed. For example the signal can be transmitted to an external display device such as a VU-meter, a bargraph, or a digital display.

The safety device 1 includes means enabling the brake 2 to be powered electrically. In the example shown, these means comprise an electronic switch 32 and two contact switches 15 and 16, each capable of acting on two power supply lines of the brake 2 for greater safety.

The electronic switch 22 may be powered firstly by the AC mains at 50 hertz (Hz) or 60 Hz (e.g. at 110 V, 220 V, single phase, or 400 V three phase) via a rectifier 11, and secondly, in the event of a mains failure, by a battery 12 connected to a voltage-raising device 20, the battery 12 being recharged by a charger 13 connected to mains. By way of example, the battery 12 is a Pb, NiCd, NiMH, lithium ion, or lithium polymer battery delivering a voltage of 12 V or 24 V, and the voltage-raising device may be arranged, for example, to deliver 200 V DC.

In the elevator shown, the control device 10 receives information about the state of the contacts of the switches 15 and 16 and also about the state of the brake 2, thus making it possible to detect and indicate a fault in the operation of the safety device 1.

By way of example, the switch 15 is a relay controlled by a signal $A_V$ generated by an action taken by the operator in charge of launching operation of the safety device 1. By way of example, the signal $A_V$ is constituted by a voltage applied under the control of a key-driven switch, a keypad identification device, an electronic key, a magnetic card device, or by a biometric device.

The switch 15 need not be a relay but could be a purely mechanical contactor, e.g. a contactor having a key, a lever, or a pushbutton. Under such circumstances, the signal $A_V$ is a mechanical action exerted directly on the switch 15 by the operator.

The switch 16 may be a relay powered by a control device 23 when the control device receives both a signal $A_F$ generated by an action of the operator and a control signal $C_f$ coming from the control device 10.

By way of example, the signal $A_F$ can be constituted by applying a voltage generated by turning a key contactor, by recognizing a code input on a keypad, by actuating a control button, or by actuating a lever. Where appropriate, the signals $A_F$ and $A_V$ can both be applied using the same key or control button operated contactor.

The presence of the control device 23 provides additional safety since in the absence of the signal $A_F$, the switch 16 remains open-circuit, even if the control device 10 is generating the closure signal $C_f$.

In the example described, the control device 10 receives a signal N representative of the cabin going past each floor. This may be a binary signal, for example.

The control device 10 is arranged to control closing and opening of the electronic switch 22, which comprises, for example, electronic power components. The control device 10 automatically generates the control signal applied to the electrical switch so that the speed of the cabin 4 does not exceed the predefined limit $V_m$.

Figure 2:
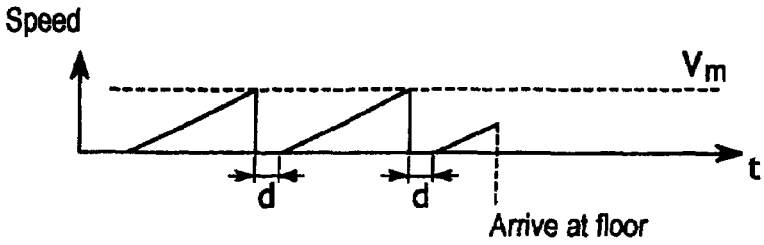
FIG. 2 shows how the speed of the cabin varies over time during operation of the safety device.

FIG. 2 shows the speed of the cabin 4 as a function of time after the operator has launched operation of the safety device 1.

The switches 15 and 16 can remain ON throughout the operation of the safety device while the switch 22 is ON only intermittently. In a variant, the switch 16 is ON intermittently, being switched ON immediately before the electronic switch 22 and being switched OFF immediately after the electronic switch 22 so as to avoid stressing its contacts, while increasing safety in the event of a failure of the electronic switch 22.

When the switch 22 is ON, the brake 2 is powered, thus enabling the cabin 4 to pick up speed under the effect of the unbalance between its own weight and the weight of the counterweight 7.

The rotation of the rotor 6 as the result of the cabin 4 moving is accompanied by a voltage V being induced, which voltage is analyzed by the control device 10 for comparison with the limit speed $V_m$.

The speed of the cabin tends to increase substantially linearly, as can be seen in FIG. 2, and on reaching the limit speed $V_m$, the control device 10 causes the electronic switch 22 to be switched OFF, thereby releasing the brake 2 and preventing the rotor 6 from rotating.

In order to avoid the cabin moving with too much oscillation, a time-out of a duration d is allowed to elapse before the electronic switch 22 is switched back ON again, and sequences during which power is applied to the brake 2 follow one another until the cabin 4 reaches a floor. The time-out d may be a duration lying in the range about 0.5 seconds (s) to about 10 s, for example.

The control device 10 is arranged in such a manner that when the signal N indicates that the cabin 4 has reached a floor, then the electronic switch 22 remains open-circuit. The control signal $C_f$ for controlling the switch 16 can also take on a state corresponding to said switch 16 being open-circuit.

Where appropriate, the control device 10 can be arranged to enable the operator to restart operation of the safety device 1 until the cabin 4 reaches the next floor, by sending a corresponding order to the control device 10, e.g. via an input reserved for this purpose.

Thereafter, the operator can cause the doors to be unlocked, should that be necessary, so as to allow the cabin to be evacuated.

In the example described, the safety device 1 is designed so that the cabin 4 stops at the nearest floor. In a variant embodiment of the invention, the control device 10 is arranged to control the electronic switch 22 in sequential manner until the cabin reaches a predefined floor, e.g. the ground floor, e.g. corresponding to receiving a particular predefined signal N or any other corresponding signal.

The states of the contacts of the switches 15, 16 and the state of the brake 2 can be monitored continuously.

The control device 10 can be arranged to deliver a signal D indicating a fault, e.g. in the event of an inconsistency between the amplitude of the remanent voltage supplied by the motor 3 and the frequency of said voltage, or whenever the information representative of the states of the switches 15 and 16 is inconsistent with the state of the brake 2.

By way of example, the signal D can cause an error message to be displayed, an indicator light to be switched ON, and/or an audible signal to be issued.

Naturally, numerous modifications can be applied to the invention without thereby going beyond the ambit of the invention.

For example, it is possible to replace the electronic switch 22 by an electromechanical switch.

Throughout the description, including in the claims, the term "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A safety device for an elevator comprising a cabin, a counterweight, a cabin drive motor, said motor having a rotor, and at least one power-failure electromechanical brake, the safety device comprising a control device arranged:

to receive at least one information allowing emergency power to be applied to the brake in order to release the rotor and allow the cabin blocked between two floors to move under an effect of unbalance between the weight of the cabin and the weight of the counterweight;

to receive at least one information enabling a speed of the cabin to be known; and to manage power supply to the brake in such a manner as to enable the cabin to move to an evacuation floor under the effect of being out of balance with the counterweight, while preventing the speed of the cabin from exceeding a predefined limit, wherein the information enabling the speed of the cabin to be known is provided by at least one electrical magnitude from the motor.

2. A device according to claim 1, in which the control device is arranged to receive information representative of the cabin arriving at the evacuation floor, and for automatically interrupting the power supplied to the brake when the information is received.

3. A device according to claim 2, in which the evacuation floor is a floor other than the floors between which the cabin was initially situated.

4. A device according to claim 1, in which the control device is arranged to analyze information representative of an amplitude of voltage induced by the rotation of the rotor and a frequency of the voltage, and in the event of inconsistency, to generate an error signal.

5. A device according to claim 1, comprising a battery for powering the brake in an absence of main electricity.

6. A device according to claim 5, comprising a voltage-raising device for raising the voltage delivered by the battery to a value compatible with powering the brake.

7. A device according to claim 1, in which the brake is powered intermittently with a time-out of a predetermined duration between two consecutive periods of power being applied to the brake.

8. A device according to claim 7, in which the time-out lies in a range from about 0.5 s to about 10 s.

9. A device according to claim 1, comprising a brake power supply circuit having at least first and second contact switches that must both be ON to allow power to be applied to the brake, the first switch being controlled by a signal that is independent of the control device, the second switch being controlled both by a signal that is independent of the control device and by a signal coming from the control device.

10. A safety device for an elevator comprising a cabin, a counterweight, a cabin drive motor, the motor having a rotor, and at least one power-failure electromechanical brake, the safety device comprising a control device arranged:

to receive at least one information allowing emergency power to be applied to the brake in order to release the rotor and allow the cabin blocked between two floors to move under an effect of an unbalance between the weight of the cabin and the weight of the counterweight;

to receive at least one information enabling a speed of the cabin to be known; and to manage power supplied to the brake in such a manner as to enable the cabin to move to an evacuation floor under the effect of being out of balance with the counterweight, while preventing the speed of the cabin from exceeding a predefined limit, further comprising a brake power supply circuit having at least first and second contact switches that must both be ON to allow power to be applied to the brake, the first switch being controlled by a signal that is independent of the control device, the second switch being controlled both by a signal that is independent of the control device and by a signal coming from the control device.

11. Elevator machinery fitted with a safety device according to claim 1.

12. An elevator fitted with a safety device according to claim 1.

* * * * *